US011527214B2

(12) United States Patent
Meng et al.

(10) Patent No.: US 11,527,214 B2
(45) Date of Patent: Dec. 13, 2022

(54) IMAGE PROCESSING METHOD, IMAGE PROCESSING CIRCUIT AND DISPLAY APPARATUS

(71) Applicants: Hefei Xinsheng Optoelectronics Technology Co., Ltd., Anhui (CN); BOE Technology Group Co., Ltd., Beijing (CN)

(72) Inventors: Song Meng, Beijing (CN); Zhongyuan Wu, Beijing (CN)

(73) Assignees: HEFEI XINSHENG OPTOELECTRONICS TECHNOLOGY CO., LTD., Anhui (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/428,178

(22) PCT Filed: Jan. 20, 2021

(86) PCT No.: PCT/CN2021/072881
§ 371 (c)(1),
(2) Date: Aug. 3, 2021

(87) PCT Pub. No.: WO2021/147904
PCT Pub. Date: Jul. 29, 2021

(65) Prior Publication Data

US 2022/0122556 A1 Apr. 21, 2022

(30) Foreign Application Priority Data

Jan. 22, 2020 (CN) ..... 202010074912.9

(51) Int. Cl.
*G09G 3/36* (2006.01)
*G09G 3/20* (2006.01)
*G09G 3/3208* (2016.01)

(52) U.S. Cl.
CPC ..... *G09G 3/3607* (2013.01); *G09G 3/2003* (2013.01); *G09G 3/3208* (2013.01);
(Continued)

(58) Field of Classification Search
CPC .. G09G 3/3607; G09G 3/2003; G09G 3/3208; G09G 2300/0452; G09G 2340/06; G09G 2360/16
See application file for complete search history.

(56) References Cited

U.S. PATENT DOCUMENTS 10,629,140 B2 * 4/2020 Zha ..... G09G 3/342
2010/0007679 A1 1/2010 Sakaigawa
(Continued)

FOREIGN PATENT DOCUMENTS

CN 101630498 A 1/2010
CN 104269138 A 1/2015
(Continued)

OTHER PUBLICATIONS

CN 2020100749129 first office action.
(Continued)

*Primary Examiner* — Kenneth B Lee, Jr.
(74) *Attorney, Agent, or Firm* — IPro, PLLC

(57) ABSTRACT

An image processing method, an image processing circuit and a display apparatus are provided. The image processing method includes: converting an RGB gray-scale value of each pixel in a current image frame into an RGB luminance value; converting the RGB luminance value into a first RGBW luminance value; determining a luminance level of the current image frame according to the first RGBW
(Continued)

luminance value corresponding to each pixel; determining a luminance gain value of the current image frame according to the luminance level of the current image frame; calculating a second RGBW luminance value according to the luminance gain value and the first RGBW luminance value; and converting the second RGBW luminance value into an RGBW gray-scale value.

17 Claims, 6 Drawing Sheets

(52) U.S. Cl.
CPC . *G09G 2300/0452* (2013.01); *G09G 2340/06* (2013.01); *G09G 2360/16* (2013.01)

(56) References Cited

U.S. PATENT DOCUMENTS

| | | | |
|---|---|---|---|
| 2013/0257924 | A1 | 10/2013 | Hirashima et al. |
| 2016/0253942 | A1 | 9/2016 | Tseng et al. |
| 2018/0211577 | A1 | 7/2018 | Pan et al. |
| 2021/0335293 | A1 | 10/2021 | Lee |

FOREIGN PATENT DOCUMENTS

| | | | |
|---|---|---|---|
| CN | 106098009 | A | 11/2016 |
| CN | 106652937 | A | 5/2017 |
| CN | 106791755 | A | 5/2017 |
| CN | 109285513 | A | 1/2019 |
| CN | 110085174 | A | 8/2019 |
| CN | 110634455 | A | 12/2019 |
| CN | 111277810 | A | 6/2020 |
| JP | 2006163068 | A | 6/2006 |

OTHER PUBLICATIONS

CN 2020100749129 second office action.
PCT/CN2021/072881 international search report and written opinion.

* cited by examiner

IMAGE PROCESSING METHOD, IMAGE PROCESSING CIRCUIT AND DISPLAY APPARATUS

CROSS-REFERENCE TO RELATED APPLICATIONS

The present application is the U.S. national phase of PCT Application No. PCT/CN2021/072881 filed on Jan. 20, 2021, which claims priority to Chinese Patent Application No. 202010074912.9 filed in China on Jan. 22, 2020, both disclosures of which are incorporated herein by reference in their entireties.

TECHNICAL FIELD

Embodiments of the present disclosure relate to the field of image processing technology, in particular to an image processing method, an image processing circuit and a display apparatus.

BACKGROUND

The current mature mass production technology of large-size OLED (organic light emitting diode) display apparatuses commonly adopts a light-emitting mode where a white OLED device and a color film array are integrated. In the light-emitting mode, the white light OLED device is evaporated by using an open mask, so as to form an array including R, G and B filter units with a color filter. As compared with an FMM (fine metal mask) RGB evaporation mode commonly used for small-size OLEDs, such problem as cross color caused by overhanging of an FMM when a glass substrate is relatively large may be solved in a better manner, and it is suitable for high-generation line production.

SUMMARY

In a first aspect, embodiments of the present disclosure provide an image processing method applied to a display apparatus, including: converting an RGB gray-scale value of each pixel in a current image frame into an RGB luminance value; converting the RGB luminance value into a first RGBW luminance value; determining a luminance level of the current image frame according to the first RGBW luminance value corresponding to each pixel; determining a luminance gain value of the current image frame according to the luminance level of the current image frame; calculating a second RGBW luminance value according to the luminance gain value and the first RGBW luminance value; and converting the second RGBW luminance value into an RGBW gray-scale value.

Optionally, the converting the RGB gray-scale value of each pixel in the current image frame into the RGB luminance value includes: converting the RGB gray-scale value of each pixel in the current image frame into the RGB luminance value by looking up an RGB gray scale-RGB luminance correspondence table.

Optionally, the converting the RGB gray-scale value of each pixel in the current image frame into the RGB luminance value includes: converting the RGB gray-scale value of each pixel in the current image frame into the RGB luminance value through the following calculation formulas:

$$LR=(R/GL)^{\gamma},LG=(G/GL)^{\gamma},LB=(B/GL)^{\gamma};$$

where, LR is an RGB luminance value of a red sub-pixel, R is an RGB gray-scale value of the red sub-pixel, LG is an RGB luminance value of a green sub-pixel, G is an RGB gray-scale value of the green sub-pixel, LB is an RGB luminance value of a blue sub-pixel, B is an RGB gray-scale value of the blue sub-pixel, GL is a maximum gray-scale value, and Y is a Gamma value.

Optionally, the converting the RGB luminance value into the first RGBW luminance value includes: converting the RGB luminance value into the first RGBW luminance value through the following calculation formulas:

$$Lw=\min(LR,LG,LB),Lr=LR-Lw,Lg=LG-Lw,Lb=LB-Lw;$$

where, Lw is an RGBW luminance value of a white sub-pixel, Lr is an RGBW luminance value of a red sub-pixel, Lg is an RGBW luminance value of a green sub-pixel, Lb is an RGBW luminance value of a blue sub-pixel, LR is an RGB luminance value of the red sub-pixel, LG is an RGB luminance value of the green sub-pixel, and LB is an RGB luminance value of the blue sub-pixel.

Optionally, the luminance level of the current image frame is a sum of luminance values of various pixels in the current image frame, and the determining the luminance level of the current image frame according to the first RGBW luminance value corresponding to each pixel includes: determining the luminance level of the current image frame by using the following calculation formula:

$$\text{sum}=\sum_{i=1}^{l1}\sum_{j=1}^{l2}(Lr_{i,j}+Lg_{i,j}+Lb_{i,j}+Lw_{i,j})$$

where, sum is the sum of the luminance values of various pixels in the current image frame, l1 is the number of pixels in a row direction of the display apparatus, l2 is the number of pixels in a column direction of the display apparatus, $Lr_{i,j}$ is an RGBW luminance value of a red sub-pixel in an (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, and $Lw_{i,j}$ is an RGBW luminance value of a white sub-pixel in the (i, j)th pixel.

Optionally, the luminance level of the current image frame is an average luminance level of the current image frame, and the determining the luminance level of the current image frame according to the first RGBW luminance value corresponding to each pixel includes: determining the average luminance level of the current image frame by using the following calculation formulas:

$$\text{sum}=\sum_{i=1}^{l1}\sum_{j=1}^{l2}(Lr_{i,j}+Lg_{i,j}+Lb_{i,j}+Lw_{i,j})$$

$$APL=\text{sum}/(l1*l2)$$

where, sum is a sum of luminance values of various pixels in the current image frame, APL is the average luminance level of the current image frame, l1 is the number of pixels in a row direction of the display apparatus, l2 is the number of pixels in a column direction of the display apparatus, $Lr_{i,j}$ is an RGBW luminance value of a red sub-pixel in an (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, and $Lw_{i,j}$ is an RGBW luminance value of a white sub-pixel in the (i, j)th pixel.

Optionally, the luminance level of the current image frame is a relative luminance level, and the determining the luminance level of the current image frame according to the first RGBW luminance value corresponding to each pixel includes: determining the relative luminance level of the current image frame by using the following calculation formulas:

$$\text{sum} = \sum_{i=1}^{l1} \sum_{j=1}^{l2} (Lr_{i,j} + Lg_{i,j} + Lb_{i,j} + Lw_{i,j})$$

$$K = \text{sum}/\text{sum}_{max}$$

where, sum is a sum of luminance values of various pixels in the current image frame, K is the relative luminance level of the current image frame, l1 is the number of pixels in a row direction of the display apparatus, l2 is the number of pixels in a column direction of the display apparatus, $Lr_{i,j}$ is an RGBW luminance value of a red sub-pixel in an (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, $Lw_{i,j}$ is an RGBW luminance value of a white sub-pixel in the (i, j)th pixel, and $\text{sum}_{max}$ is a maximum luminance value of the display apparatus.

Optionally, the determining the luminance gain value of the current image frame according to the luminance level of the current image frame includes: determining an average luminance level of the current image frame according to the sum of the luminance values of various pixels in the current image frame; and determining the luminance gain value of the current image frame by looking up an average luminance level-luminance gain value correspondence table.

Optionally, the determining the luminance gain value of the current image frame according to the luminance level of the current image frame includes: determining the luminance gain value of the current image frame by looking up an average luminance level-luminance gain value correspondence table.

Optionally, the determining the luminance gain value of the current image frame according to the luminance level of the current image frame includes: determining an average luminance level of the current image frame according to the relative luminance level K of the current image frame, the maximum luminance value $\text{sum}_{max}$ of the display apparatus and an average luminance level $\text{APL}_{max}$ corresponding to the maximum luminance value of the display apparatus; and determining the luminance gain value of the current image frame by looking up an average luminance level-luminance gain value correspondence table.

Optionally, in a case that the average luminance level of the current image frame does not exceed a predetermined value, the luminance gain value of the current image frame is 1; and in a case that the average luminance level of the current image frame exceeds the predetermined value, the luminance gain value of the current image frame decreases as the average luminance level increases.

Optionally, the predetermined value is an average luminance level when a red color image, a green color image or a blue color image is displayed.

Optionally, $\text{APL}_{max}$ is an average luminance level when any two of a red color image, a green color image and a blue color image are displayed.

Optionally, the calculating the second RGBW luminance value according to the luminance gain value and the first RGBW luminance value includes: calculating the second RGBW luminance value by using the following calculation formulas:

$$L'r = \text{gain} \cdot Lr, L'g = \text{gain} \cdot Lg, L'b = \text{gain} \cdot Lb, L'w = Lw + (1 - \text{gain}) * Lr + Lg + Lb)/3;$$

where, L'r is a second RGBW luminance value of a red sub-pixel, L'g is a second RGBW luminance value of a green sub-pixel, L'b is a second RGBW luminance value of a blue sub-pixel, L'w is a second RGBW luminance value of a white sub-pixel, gain is the luminance gain value, Lw is a first RGBW luminance value of the white sub-pixel, Lr is a first RGBW luminance value of the red sub-pixel, Lg is a first RGBW luminance value of the green sub-pixel, and Lb is a first RGBW luminance value of the blue sub-pixel.

In a second aspect, the embodiments of the present disclosure provide an image processing circuit including: a first conversion circuit, configured to convert an RGB gray-scale value of each pixel in a current image frame into an RGB luminance value; a second conversion circuit, configured to convert the RGB luminance value into a first RGBW luminance value; a first determination circuit, configured to determine a luminance level of the current image frame according to the first RGBW luminance value corresponding to each pixel; a second determination circuit, configured to determine a luminance gain value of the current image frame according to the luminance level of the current image frame; a calculation circuit, configured to calculate a second RGBW luminance value according to the luminance gain value and the first RGBW luminance value; and a third conversion circuit, configured to convert the second RGBW luminance value into an RGBW gray-scale value.

In a third aspect, the embodiments of the present disclosure provide a display apparatus including the above image processing circuit.

In a fourth aspect, the embodiments of the present disclosure provide a display apparatus including a processor, a memory, and a computer program stored on the memory and executable on the processor. The computer program is executed by the processor to implement the steps of the image processing method in the above first aspect.

In a fifth aspect, the embodiments of the present disclosure provide a computer-readable storage medium having stored thereon a computer program. The computer program is executed by a processor to implement the steps of the image processing method in the above first aspect.

BRIEF DESCRIPTION OF THE DRAWINGS

Through the detailed description mentioned hereinafter, the and other advantages and benefits will be apparent to a person skilled in the art. The following drawings are for illustrative purposes only, but shall not be construed as limiting the present disclosure. In the drawings, a same reference numeral represents a same member. In these drawings.

DETAILED DESCRIPTION

The technical solutions in the embodiments of the present disclosure will be described hereinafter clearly and completely with reference to the drawings of the embodiments of the present disclosure. Obviously, the following embodiments merely relate to a part of, rather than all of, the embodiments of the present disclosure, and based on these embodiments, a person of ordinary skill in the art may, without any creative effort, obtain other embodiments, which also fall within the scope of the present disclosure.

Figure 1:
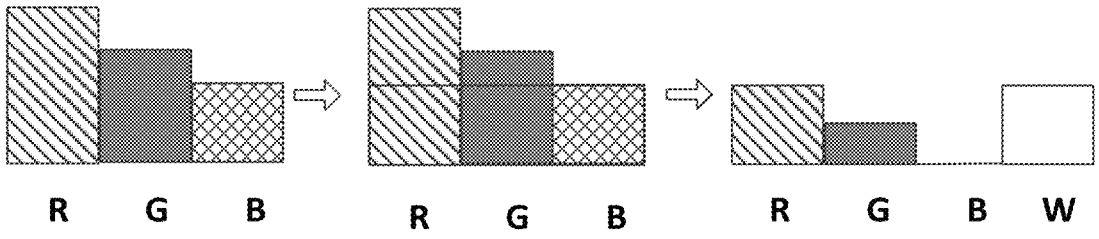
FIG. 1 is a schematic diagram of an RGB to RGBW conversion method in the related art.

In a pixel design of a large-size OLED display apparatus, an arrangement of pixels is designed as an arrangement of R, G, B and W sub-pixels. When a white image is displayed, the white sub-pixels are used instead of R, G and B sub-pixels to emit light as far as possible, so as to reduce the power consumption. An RGB to RGBW conversion algorithm in the related art is as shown in FIG. 1.

Although the power consumption of displaying the white image is reduced by using the above algorithm, when a solid color image is displayed, only solid color sub-pixels are energized, so as to cause a relatively large power consumption due to about ⅔ of a luminance capacity loss of light emitted by a white OLED device when passing through a color film. For example, power consumptions of a 55" OLED TV when displaying various images are shown in Table 1. When a white image is displayed, a power consumption is 174 W, but when a yellow image is displayed, a power consumption is up to 385.8 w, which is 2.2 times of the power consumption of displaying the white image. Although such an image with a heavy load is not frequently displayed, it is necessary to consider the occurrence of a peak power consumption when a system is designed, a power panel needs to be designed according to a maximum specification, and thus the power consumption and the cost are high. Therefore, it is necessary to develop a method for reducing the power consumption.

TABLE 1

Power consumptions of a 65 UHD OLED TV

| | | 65 UHD OLED TV |
|---|---|---|
| L255 (White) | EL power consumption | 174 |
| | Luminance value | 119 |

TABLE 1-continued

Power consumptions of a 65 UHD OLED TV

| | | 65 UHD OLED TV |
|---|---|---|
| R255 (Red) | EL power consumption | 317 |
| | Luminance value | 30 |
| G255 (Green) | EL power consumption | 259 |
| | Luminance value | 93 |
| B255 (Blue) | EL power consumption | 195 |
| | Luminance value | 12 |
| RG (Yellow) | EL power consumption | 385.8 |
| | Luminance value | 98.4 |
| RB (Purple) | EL power consumption | 379.3 |
| | Luminance value | 34.6 |
| GB (Cyan) | EL power consumption | 368 |
| | Luminance value | 104.5 |

Figure 2:
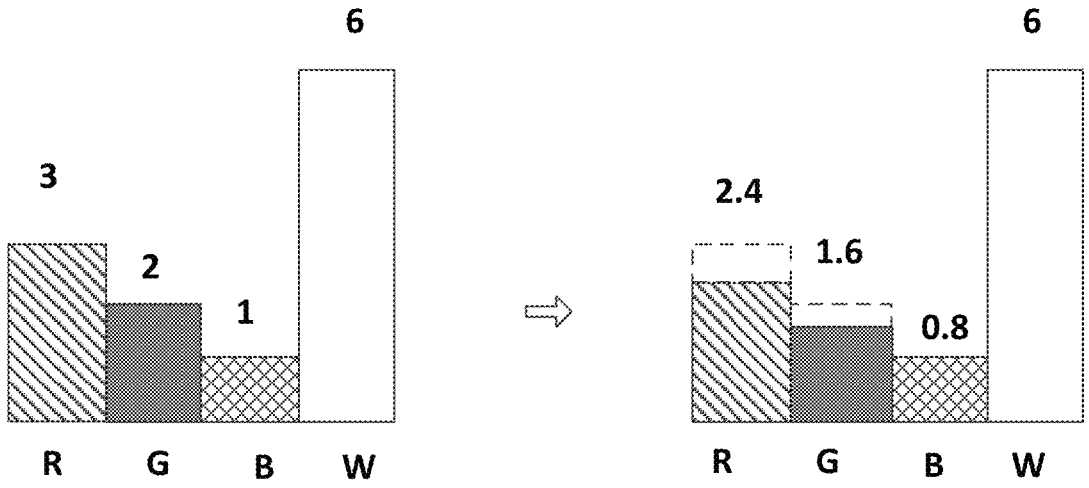
FIG. 2 is a schematic diagram of an image processing method in the related art.

In a related solution, an RGBW luminance clipping (adjusting) method may be used to reduce the power consumption of a white OLED display apparatus. According to the RGBW luminance clipping method, the power consumption is reduced by reducing a maximum luminance value when a solid color image is displayed. As shown in FIG. 2, it is assumed that a maximum luminance value of a white sub-pixel in a standard display is 6, a maximum luminance value of a red sub-pixel of 3, a maximum luminance value of a green sub-pixel of 2 and a maximum luminance value of a blue sub-pixel of 1 are normally required. When the luminance clipping method is used, maximum luminance values of the red sub-pixel, the green sub-pixel and the blue sub-pixel are respectively reduced to 2.4, 1.6 and 0.8. Although the power consumption of the white OLED display apparatus when displaying the solid color image may be reduced, the maximum luminance values of the red sub-pixel, the green sub-pixel and the blue sub-pixel are also reduced, which affects the contrast of an image and causes a local color deviation of the image.

Figure 3:
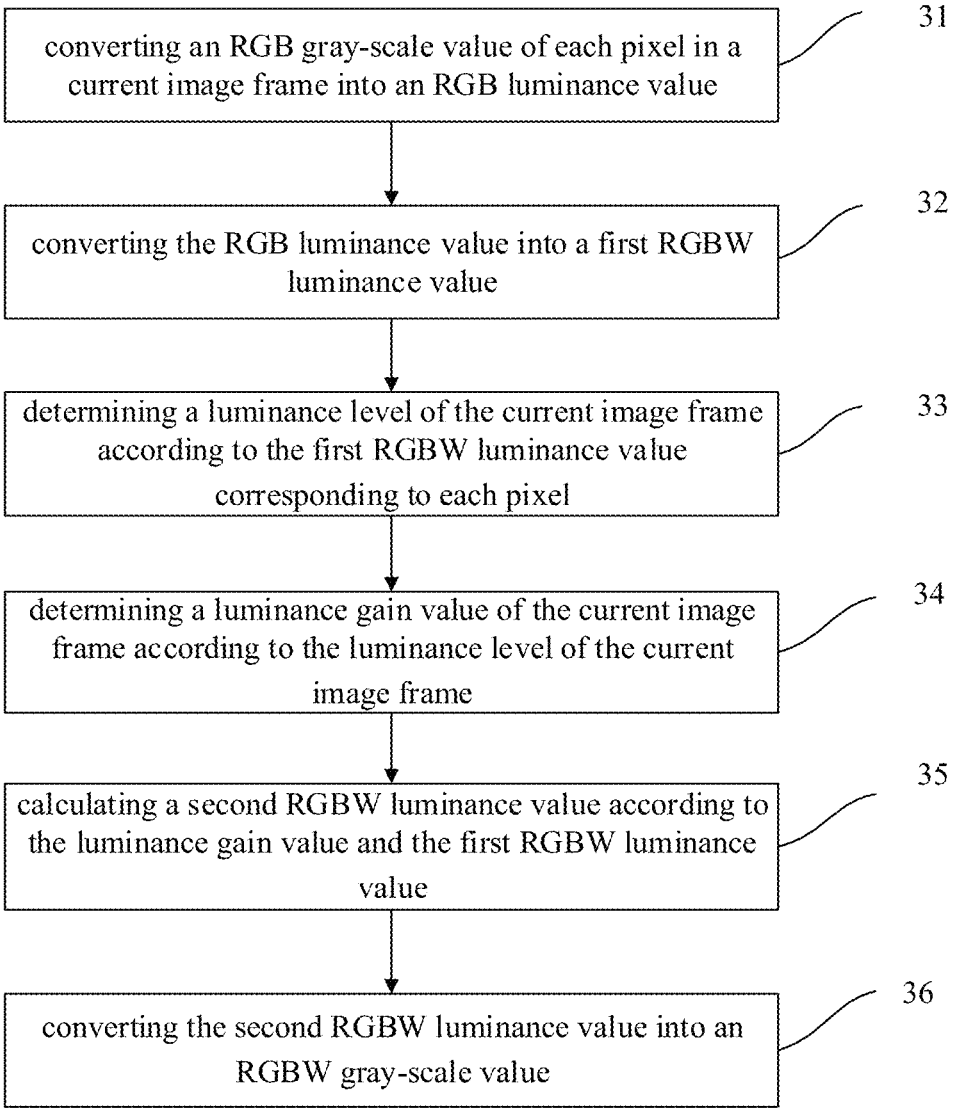
FIG. 3 is a flowchart diagram of an image processing method according to an embodiment of the present disclosure.

To solve the above problems, referring to FIG. 3, the embodiments of the present disclosure provides an image processing method applied to a display apparatus, including the following steps.

Step 31: an RGB gray-scale value of each pixel in a current image frame is converted into an RGB luminance value.

In the embodiments of the present disclosure, the RGB gray-scale value is referred to as a gray-scale value of the pixel in an RGB display mode, and the RGB luminance value is referred to as a luminance value in the RGB display mode.

Step 32: the RGB luminance value is converted into a first RGBW luminance value.

In the embodiments of the present disclosure, the RGBW luminance value is referred to as a luminance value of the pixel in an RGBW display mode, and the first RGBW luminance value is a first luminance value of the pixel in the RGBW display mode.

Step 33: a luminance level of the current image frame is determined according to the first RGBW luminance value corresponding to each pixel.

In some embodiments, the luminance level of the current image frame may be a sum (or called as the total luminance) of luminance values of various pixels in the current image frame, an average luminance level of the current image frame, or a relative luminance level of the current image frame.

Step 34: a luminance gain value of the current image frame is determined according to the luminance level of the current image frame;

Step 35: a second RGBW luminance value is calculated according to the luminance gain value and the first RGBW luminance value;

Step 36: the second RGBW luminance value is converted into an RGBW gray-scale value.

In the embodiments of the present disclosure, the RGBW gray-scale value is referred to as a gray-scale value of the pixel in the RGBW display mode.

In the embodiments of the present disclosure, the luminance gain value is determined based on the luminance level of the current image frame, and the first RGBW luminance value of the pixel is adjusted, so as to reduce the power consumption of the display apparatus without affecting the image contrast.

Specific implementations of various steps in the above embodiments are described in detail below.

1) Step 31 Above: A Gray Scale to Luminance Conversion (G to L Conversion)

In some embodiments of the present disclosure, the RGB gray-scale value of each pixel in the current image frame may be converted into the RGB luminance value by looking up an RGB gray scale-RGB luminance correspondence table.

That is, a pre-configured gray scale-luminance correspondence table including luminance values corresponding to gray-scale values of a red sub-pixel, a green sub-pixel and a blue sub-pixel may be stored. For each sub-pixel (the red sub-pixel, the green sub-pixel and the blue sub-pixel) in each pixel of the current image frame, the gray scale to luminance conversion is realized by looking up the RGB gray scale-RGB luminance correspondence table.

By means of table lookup, the luminance values corresponding to the gray-scale values of the red sub-pixel, the green sub-pixel and the blue sub-pixel of each pixel in the current image frame may be quickly obtained, and thus the running speed is improved.

In some other embodiments of the present disclosure, the RGB gray-scale value of each pixel in the current image frame may also be converted into the RGB luminance value through the following calculation formulas:

$$LR=(R/GL)^{\gamma}, LG=(G/GL)^{\gamma}, LB=(B/GL)^{\gamma};$$

where, LR is an RGB luminance value of a red sub-pixel, R is an RGB gray-scale value of the red sub-pixel, LG is an RGB luminance value of a green sub-pixel, G is an RGB gray-scale value of the green sub-pixel, LB is an RGB luminance value of a blue sub-pixel, B is an RGB gray-scale value of the blue sub-pixel, GL is a maximum gray-scale value, and Y is a Gamma value.

It is assumed that the display apparatus has an 8-bit gray scale, and GL is 255.

In some embodiments, the Gamma value may range from 1.8 to 2.6, and optionally may be 2.2.

2) Step 32 Above: An RGB to RGBW Luminance Conversion (RGB to RGBW Conversion)

In some embodiments of the present disclosure, the RGB luminance value may be converted into the first RGBW luminance value through the following calculation formulas:

$$Lw=\min(LR,LG,LB), Lr=LR-Lw, Lg=LG-Lw, Lb=LB-Lw;$$

where, Lw is an RGBW luminance value of a white sub-pixel, Lr is an RGBW luminance value of a red sub-pixel, Lg is an RGBW luminance value of a green sub-pixel, Lb is an RGBW luminance value of a blue sub-pixel, LR is an RGB luminance value of the red sub-pixel, LG is an RGB luminance value of the green sub-pixel, and LB is an RGB luminance value of the blue sub-pixel.

It may be seen from the above formulas that because of Lw=min (LR, LG, LB), one of Lr, Lg and Lb is 0.

3) Step 33 Above: A Luminance Level Calculation

In some embodiments of the present disclosure, the luminance level of the current image frame is a sum of luminance values of various pixels in the current image frame, and the luminance level of the current image frame may be determined by using the following calculation formula:

$$\text{sum}=\sum_{i=1}^{l1}\sum_{j=1}^{l2}(Lr_{i,j}+Lg_{i,j}+Lb_{i,j}+Lw_{i,j})$$

where, sum is the sum of the luminance values of various pixels in the current image frame, l1 is the number of pixels in a row direction of the display apparatus, l2 is the number of pixels in a column direction of the display apparatus, $Lr_{i,j}$ is an RGBW luminance value of a red sub-pixel in an (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, and $Lw_{i,j}$ is an RGBW luminance value of a white sub-pixel in the (i, j)th pixel.

In some embodiments of the present disclosure, $Lw_{i,j}=\min(LR_{i,j}, LG_{i,j}, LB_{i,j})$.

$LR_{i,j}$ is an RGB luminance value of the red sub-pixel in the (i, j)th pixel, $LG_{i,j}$ is an RGB luminance value of the green sub-pixel in the (i, j)th pixel, and $LB_{i,j}$ is an RGB luminance value of the blue sub-pixel in the (i, j)th pixel.

In some embodiments, the luminance level of the current image frame is an average luminance level of the current image frame, and the average luminance level of the current image frame may be determined by using the following calculation formulas:

$$\text{sum}=\sum_{i=1}^{l1}\sum_{j=1}^{l2}(Lr_{i,j}+Lg_{i,j}+Lb_{i,j}+Lw_{i,j})$$

$$APL=\text{sum}/(l1*l2)$$

where, sum is a sum of luminance values of various pixels in the current image frame, APL is the average luminance level of the current image frame, l1 is the number of pixels in a row direction of the display apparatus, l2 is the number of pixels in a column direction of the display apparatus, $Lr_{i,j}$ is an RGBW luminance value of a red sub-pixel in an (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, and $Lw_{i,j}$ is an RGBW luminance values of a white sub-pixel in the (i, j)th pixel.

In some embodiments, the luminance level of the current image frame is a relative luminance level, and the relative luminance level of the current image frame may be determined by using the following calculation formulas:

$$\text{sum}=\sum_{i=1}^{l1}\sum_{j=1}^{l2}(Lr_{i,j}+Lg_{i,j}+Lb_{i,j}+Lw_{i,j})$$

$$K=\text{sum}/\text{sum}_{max}$$

where, sum is a sum of luminance values of various pixels in the current image frame, K is the relative luminance level of the current image frame, l1 is the number of pixels in a row direction of the display apparatus, l2 is the number of pixels in a column direction of the display apparatus, $Lr_{i,j}$ is an RGBW luminance value of a red sub-pixel in an (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, $Lw_{i,j}$ is an RGBW luminance value of a white sub-pixel in the (i, j)th pixel, and $sum_{max}$ is a maximum luminance value of the display apparatus.

In some embodiments, $sum_{max}$ is the maximum luminance value when any two of a red color image, a green color image and a blue color image are displayed.

In some other embodiments of the present disclosure, the luminance level of the current image frame may also be determined in other ways, for example, an area of a display window in the current image frame is calculated, and the area of the display window in the current image frame is used as the luminance level of the current image frame.

4) Step 34 Above: Gain Determination (Gain Estimation)

In some embodiments of the present disclosure, the determining the luminance gain value of the current image frame according to the luminance level of the current image frame includes: determining an average luminance level of the current image frame according to the sum of the luminance values of various pixels in the current image frame; and determining the luminance gain value of the current image frame by looking up an average luminance level-luminance gain value correspondence table.

In some embodiments of the present disclosure, the determining the luminance gain value of the current image frame according to the luminance level of the current image frame includes: determining the luminance gain value of the current image frame by looking up an average luminance level-luminance gain value correspondence table.

In some embodiments, the determining the luminance gain value of the current image frame according to the luminance level of the current image frame includes: determining an average luminance level of the current image frame according to the relative luminance level K of the current image frame, the maximum luminance value $sum_{max}$ of the display apparatus and an average luminance level $APL_{max}$ corresponding to the maximum luminance value of the display apparatus; and determining the luminance gain value of the current image frame by looking up an average luminance level-luminance gain value correspondence table.

That is, a pre-configured average luminance level-luminance gain value correspondence table including luminance gain values corresponding to various possible average luminance levels may be stored. For the average luminance level of the current image frame, a corresponding luminance gain value may be found by looking up the average luminance level-luminance gain value correspondence table.

By means of table lookup, the luminance gain value corresponding to the average luminance level of the current image frame may be quickly obtained, and thus the running speed is improved.

In the embodiment of the present disclosure, optionally, in a case that the average luminance level of the current image frame does not exceed a predetermined value, the luminance gain value of the current image frame is 1; and in a case that the average luminance level of the current image frame exceeds the predetermined value, the luminance gain value of the current image frame decreases as the average luminance level increases.

Figure 4:
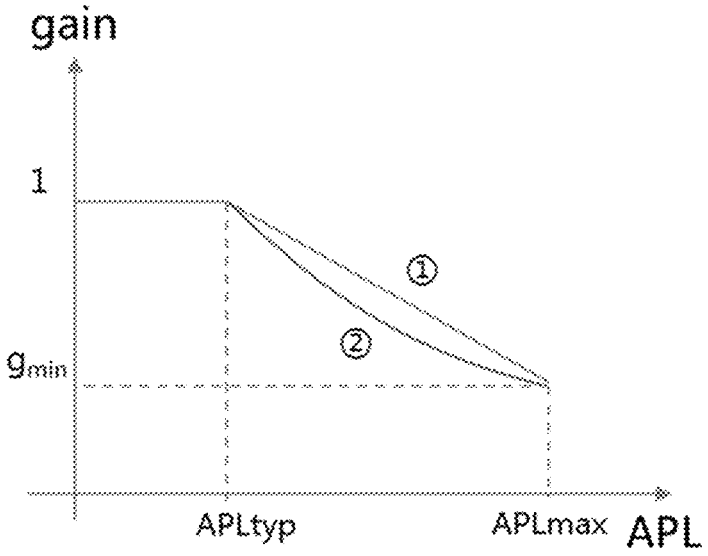
FIG. 4 is a schematic diagram of a relationship between an average luminance level and a luminance gain value according to an embodiment of the present disclosure.

Referring to FIG. 4, when an APL value of the current image frame does not exceed APLtyp (i.e. the predetermined value), the luminance gain value of the current image frame is 1, the luminance of the RGB sub-pixels are kept unchanged, and at this moment, a current load of the display apparatus is still within an acceptable range, so that the luminance and color points of the RGB sub-pixels are kept unchanged, and the image quality is maintained optimally. When the APL value of the current frame exceeds APLtyp, the current load of the display apparatus gradually increases, and at this moment, the luminance gain value gain decreases as APL increases, so that the luminance of the RGB sub-pixels decreases to reduce the power consumption.

In the embodiment of the present disclosure, optionally, when the APL value of the current image frame exceeds APLtyp, the gain value may linearly decrease as the average luminance level increases, as shown in ① of FIG. 4, or the gain value may also non-linearly decrease as the average luminance level increases, as shown in ② of FIG. 4.

In the embodiments of the present disclosure, a minimum value $g_{min}$ of gain may be set, so as to avoid excessive supplement to the white color which affect the image contrast.

In the embodiments of the present disclosure, optionally, the predetermined value APLtyp is an average luminance level when a red color image, a green color image or a blue color image is displayed.

In some embodiments, $APL_{max}$ is an average luminance level when any two of a red color image, a green color image and a blue color image are displayed.

5) Step 35 Above: An RGBW Recalculation (RGBW Recalculation)

In some embodiments of the present disclosure, optionally, the second RGBW luminance value is calculated by using the following calculation formulas:

$$L'r=\text{gain}\cdot Lr, L'g=\text{gain}\cdot Lg, L'b=\text{gain}\cdot Lb, L'w=Lw+(1-\text{gain})*(Lr+Lg+Lb)/3;$$

where, L'r is a second RGBW luminance value of a red sub-pixel, L'g is a second RGBW luminance value of a green sub-pixel, L'b is a second RGBW luminance value of a blue sub-pixel, L'w is a second RGBW luminance value of a white sub-pixel, and gain is the luminance gain value, Lw is a first RGBW luminance value of the white sub-pixel, Lr is a first RGBW luminance value of the red sub-pixel, Lg is a first RGBW luminance value of the green sub-pixel, and Lb is a first RGBW luminance value of the blue sub-pixel.

It should be appreciated that in a case that the calculation formulas of Step 32 are used to calculate the RGBW luminance value, one of Lr, Lg and Lb is 0, and at this step, actually, only two of L'r, L'g and L'b need to be subjected to an RGBW recalculation.

At this step, the luminance values of the R, G and B sub-pixels are correspondingly reduced according to the size of the gain value, the lost luminance will cause a decrease in contrast, and the lost luminance portion needs to be supplemented with the white color, and the supplementary luminance is related to a load degree of an image. For an image with a small load, the larger the gain value, the less the supplement to the white color, and thus an effect on the image quality is small. For an image with a large load, the smaller the gain value, the more the supplement to the white color. Because the human eye is not sensitive to the change of mixed color points and is more sensitive to the contrast, an effect on the subjective image quality perception is not large.

In the above embodiments, the supplementary luminance is (1−gain)*(Lr+Lg+Lb)/3. Of course, in some other embodiments of the present disclosure, the supplementary luminance may also be calculated by using other calculation methods.

6) Step 36 Above: An RGBW Luminance Value to RGBW Gray-Scale Value Conversion In some embodiments of the present disclosure, the second RGBW luminance value may be converted into the RGBW gray-scale value by looking up an RGBW luminance-RGBW gray scale correspondence table.

That is, a pre-configured RGBW luminance-RGBW gray scale correspondence table including gray-scale values corresponding to various luminance values of the red sub-pixel, the green sub-pixel, the blue sub-pixel and the white sub-pixel may be stored. For each sub-pixel (the red sub-pixel, the green sub-pixel, the blue sub-pixel and the white sub-pixel) in each pixel, the luminance to gray scale conversion is realized by looking up the RGBW luminance-RGBW gray scale correspondence table.

By means of table lookup, the second RGBW luminance value may be quickly converted into the RGBW gray-scale value, and thus the running speed is improved.

In some other embodiments of the present disclosure, the second RGBW luminance value may also be converted into the RGBW gray-scale value through the following calculation formulas:

$$r = \sqrt[\gamma]{L'r} * GL,\ g = \sqrt[\gamma]{L'g} * GL,\ b = \sqrt[\gamma]{L'b} * GL,\ w = \sqrt[\gamma]{L'w} * GL;$$

where, L'r is the second RGBW luminance value of the red sub-pixel, L'g is the second RGBW luminance value of the green sub-pixel, L'b is the second RGBW luminance value of the blue sub-pixel, L'w is the second RGBW luminance value of the white sub-pixel, r is an RGBW gray-scale value of the red sub-pixel, g is an RGBW gray-scale value of the green sub-pixel, b is an RGBW gray-scale value of the blue sub-pixel, w is an RGBW gray-scale value of the white sub-pixel, GL is the maximum gray-scale value, and Y is a Gamma value.

It is assumed that the display apparatus has an 8-bit gray scale, and GL is 255.

The Gamma value may range from 1.8 to 2.6, and optionally may be 2.2.

Figure 5:
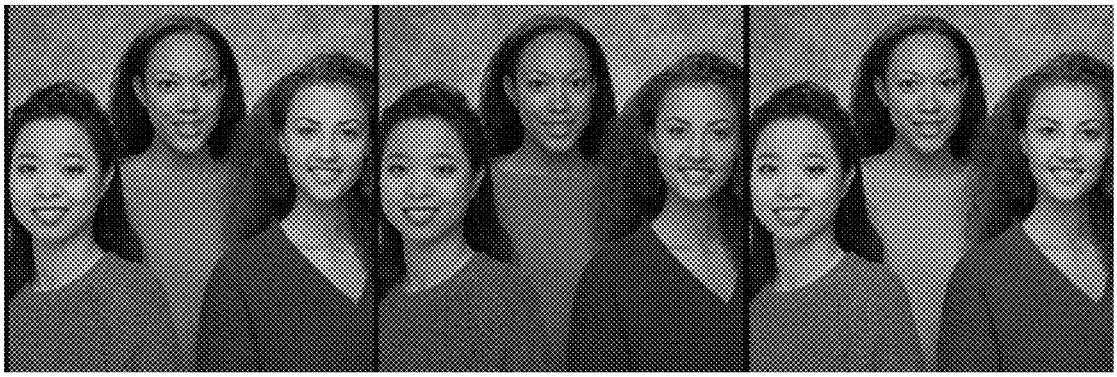
FIG. 5 is a schematic diagram of an image processing effect comparison of the image processing method according to the embodiment of the present disclosure and the image processing method in the related art.

FIG. 5 is a schematic diagram of an image processing effect comparison of the image processing method according to the embodiments of the present disclosure and the image processing method in the related art. More solid colors are provided and more power consumption (for example, a normalized power consumption value is 1.0) are caused in an original image on a far left side. After being processed by using the RGBW luminance clipping image processing method (corresponding to an image in the middle), although the power consumption is reduced to about 0.42, the luminance is significantly reduced and the contrast is reduced. After being processed by using the image processing method proposed in the embodiments of the present disclosure (corresponding to an image on the right side), the overall luminance is significantly improved, image details are more apparent, the power consumption is 0.45, which is only increased by 7% as compared with that of the image processing method in the related art, and the color change is small and still in the acceptable range.

In the embodiments of the present disclosure, all images may be processed by using the above image processing method. Or only solid color images may be processed by using the above image processing method.

The display apparatus in the embodiments of the present disclosure is a white OLED display apparatus.

Figure 6:
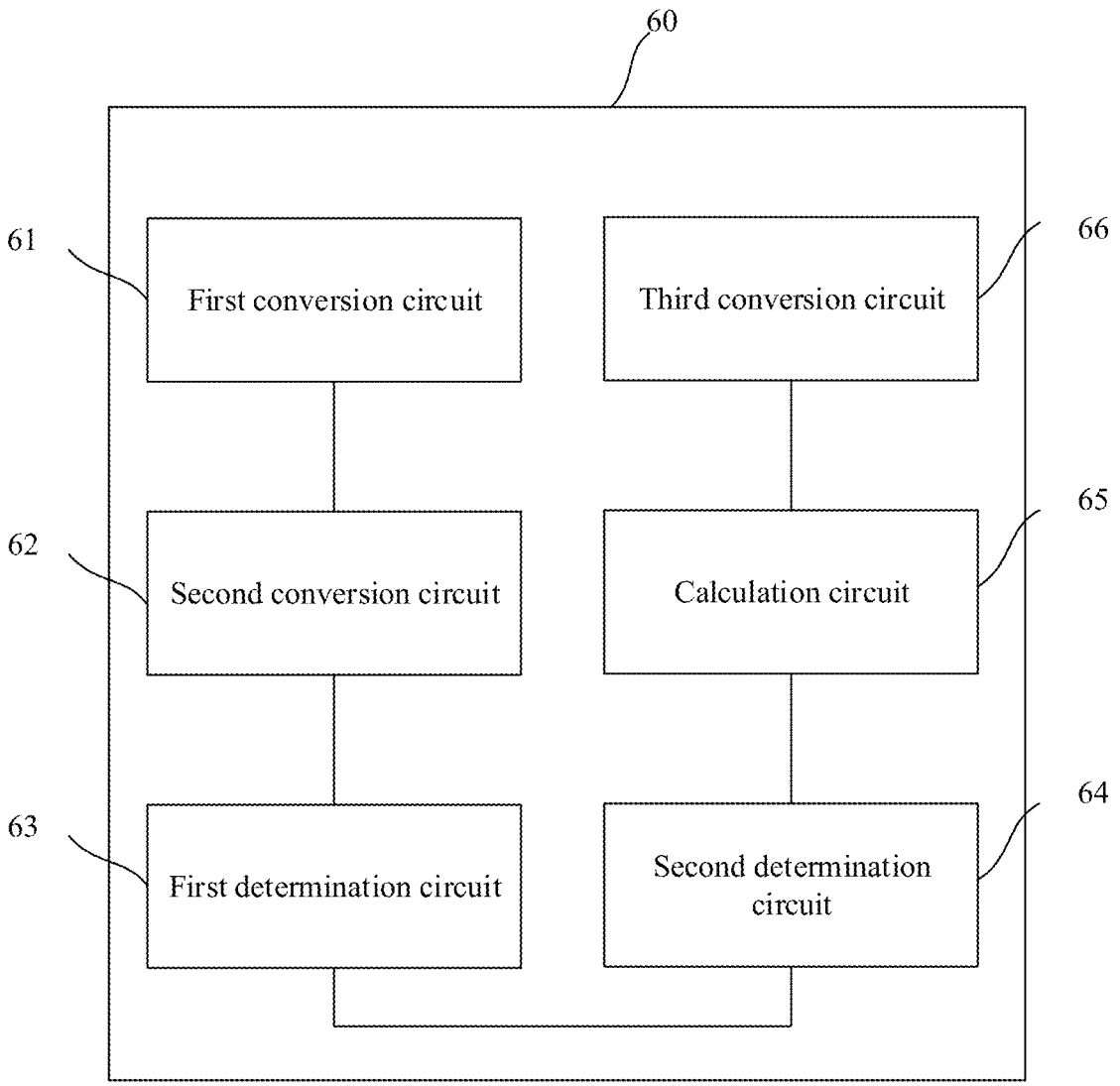
FIG. 6 is a schematic structural diagram of an image processing circuit according to an embodiment of the present disclosure.

Referring to FIG. 6, the embodiments of the present disclosure further provide an image processing circuit 60 including: a first conversion circuit 61, configured to convert an RGB gray-scale value of each pixel in a current image frame into an RGB luminance value; a second conversion circuit 62, configured to convert the RGB luminance value into a first RGBW luminance value; a first determination circuit 63, configured to determine a luminance level of the current image frame according to the first RGBW luminance value corresponding to each pixel; a second determination circuit 64, configured to determine a luminance gain value of the current image frame according to the luminance level of the current image frame; a calculation circuit 65, configured to calculate a second RGBW luminance value according to the luminance gain value and the first RGBW luminance value; and a third conversion circuit 66, configured to convert the second RGBW luminance value into an RGBW gray-scale value.

Optionally, the first conversion circuit 61 is configured to convert the RGB gray-scale value of each pixel in the current image frame into the RGB luminance value by looking up an RGB gray scale-RGB luminance correspondence table.

Optionally, the first conversion circuit 61 is configured to convert the RGB gray-scale value of each pixel in the current image frame into the RGB luminance value through the following calculation formulas:

$$LR=(R/GL)^{\gamma}, LG=(G/GL)^{\gamma}, LB=(B/GL)^{\gamma};$$

where, LR is an RGB luminance value of a red sub-pixel, R is an RGB gray-scale value of the red sub-pixel, LG is an RGB luminance value of a green sub-pixel, G is an RGB gray-scale value of the green sub-pixel, LB is an RGB luminance value of a blue sub-pixel, B is an RGB gray-scale value of the blue sub-pixel, GL is a maximum gray-scale value, and Y is a Gamma value.

Optionally, the second conversion circuit 62 is configured to convert the RGB luminance value into the first RGBW luminance value through the following calculation formulas:

$$Lw=\min(LR,LG,LB), Lr=LR-Lw, Lg=LG-Lw, Lb=LB-Lw;$$

where, Lw is an RGBW luminance value of a white sub-pixel, Lr is an RGBW luminance value of a red sub-pixel, Lg is an RGBW luminance value of a green sub-pixel, Lb is an RGBW luminance value of a blue sub-pixel, LR is an RGB luminance value of the red sub-pixel, LG is an RGB luminance value of the green sub-pixel, and LB is an RGB luminance value of the blue sub-pixel.

Optionally, when the luminance level of the current image frame is a sum of luminance values of various pixels of the current image frame, the first determination circuit 63 is configured to determine the luminance level of the current image frame by using the following calculation formula:

$$\text{sum} = \sum_{i=1}^{l1} \sum_{j=1}^{l2} (Lr_{i,j} + Lg_{i,j} + Lb_{i,j} + Lw_{i,j})$$

where, sum is the sum of the luminance values of various pixels in the current image frame, l1 is the number of pixels in a row direction of the display apparatus, l2 is the number of pixels in a column direction of the display apparatus, $Lr_{i,j}$ is an RGBW luminance value of a red sub-pixel in an (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, and $Lw_{i,j}$ is an RGBW luminance value of a white sub-pixel in the (i, j)th pixel.

Optionally, when the luminance level of the current image frame is an average luminance level of the current image frame, the first determination circuit 63 is configured to determine the average luminance level of the current image frame by using the following calculation formulas:

$$\text{sum} = \sum_{i=1}^{l1} \sum_{j=1}^{l2} (Lr_{i,j} + Lg_{i,j} + Lb_{i,j} + Lw_{i,j})$$

$$APL = \text{sum}/(l1 * l2)$$

where, sum is the sum of luminance values of various pixels in the current image frame, APL is the average luminance level of the current image frame, l1 is the number of pixels in the row direction of the display apparatus, l2 is the number of pixels in the column direction of the display apparatus, $Lr_{i,j}$ is an RGBW luminance value of a red sub-pixel in the (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, and $Lw_{i,j}$ is an RGBW luminance value of a white sub-pixel in the (i, j)th pixel.

Optionally, when the luminance level of the current image frame is a relative luminance level, the first determination circuit 63 is configured to determine the relative luminance level of the current image frame by using the following calculation formulas:

$$\text{sum} = \sum_{i=1}^{l1} \sum_{j=1}^{l2} (Lr_{i,j} + Lg_{i,j} + Lb_{i,j} + Lw_{i,j})$$

$$K = \text{sum}/\text{sum}_{max}$$

where, sum is the sum of luminance values of various pixels of the current image frame, K is the relative luminance level of the current image frame, l1 is the number of pixels in the row direction of the display apparatus, l2 is the number of pixels in the column direction of the display apparatus, $Lr_{i,j}$ is an RGBW luminance value of a red sub-pixel in the (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, $Lw_{i,j}$ is an RGBW luminance value of a white sub-pixel in the (i, j)th pixel, and $\text{sum}_{max}$ is the maximum luminance value of the display apparatus.

Optionally, the second determination circuit 64 is configured to determine the luminance gain value of the current image frame by looking up an average luminance level-luminance gain value correspondence table.

Optionally, the second determination circuit 64 is configured to determine an average luminance level of the current image frame according to the sum of the luminance values of various pixels in the current image frame; and determine the luminance gain value of the current image frame by looking up an average luminance level-luminance gain value correspondence table.

Optionally, the second determination circuit 64 is configured to determine an average luminance level of the current image frame according to the relative luminance level K of the current image frame, the maximum luminance value $\text{sum}_{max}$ of the display apparatus and an average luminance level $APL_{max}$ corresponding to the maximum luminance value of the display apparatus; and determine the luminance gain value of the current image frame by looking up an average luminance level-luminance gain value correspondence table.

Optionally, in a case that the average luminance level of the current image frame does not exceed a predetermined value, the luminance gain value of the current image frame is 1; and in a case that the average luminance level of the current image frame exceeds the predetermined value, the luminance gain value of the current image frame decreases as the average luminance level increases.

Optionally, the predetermined value is an average luminance level when a red color image, a green color image or a blue color image is displayed.

Optionally, $APL_{max}$ is an average luminance level when any two of a red color image, a green color image and a blue color image are displayed.

Optionally, the calculation circuit 65 is configured to calculate the second RGBW luminance value by using the following calculation formulas:

$$L'r = \text{gain} \cdot Lr, L'g = \text{gain} \cdot Lg, L'b = \text{gain} \cdot Lb, L'w = Lw + (1 - \text{gain}) * (Lr + Lg + Lb)/3;$$

where, L'r is a second RGBW luminance value of a red sub-pixel, L'g is a second RGBW luminance value of a green sub-pixel, L'b is a second RGBW luminance value of a blue sub-pixel, L'w is a second RGBW luminance value of a white sub-pixel, gain is the luminance gain value, Lw is a first RGBW luminance value of the white sub-pixel, Lr is a first RGBW luminance value of the red sub-pixel, Lg is a first RGBW luminance value of the green sub-pixel, and Lb is a first RGBW luminance value of the blue sub-pixel.

The embodiments of the present disclosure further provide a display apparatus including the above image processing circuit.

Figure 7:
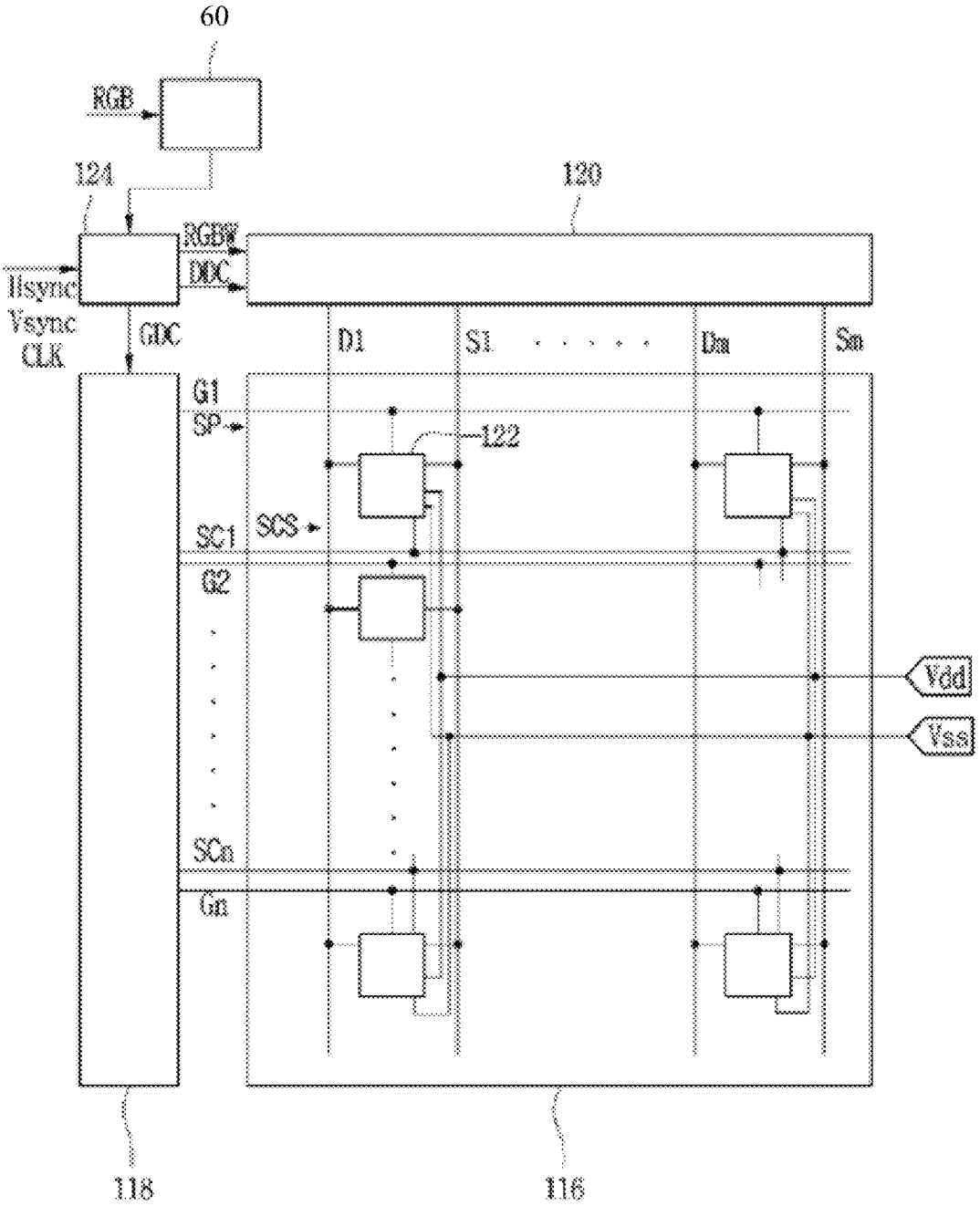
FIG. 7 is a schematic structural diagram of a display apparatus according to an embodiment of the present disclosure.

Referring to FIG. 7, the display apparatus according to the embodiments of the present disclosure may include a display panel 116, a gate driver 118, a data driver 120, a timing controller 124, and the image processing circuit 60.

The display panel 116 may include m data lines D1 to Dm, m sensing lines S1 to Sm, n gate lines G1 to Gn, n sensing control lines SC1 to SCn, and m*n pixels 122. The m data lines D1 to Dm and the m sensing lines S1 to Sm are opposite to each other one by one and form m pairs. Similarly, the n gate lines G1 to Gn and the n sensing control lines SC1 to SCn are opposite to each other one by one and form n pairs. The pixels 122 may be formed in in regions which are defined by crossing the m pairs of data lines D and the sensing lines S and the n pairs of gate lines G and the sensing control lines SC.

In addition, a first signal line and a second signal line may be formed on the display panel 116, the first signal line is configured to apply a first driving voltage Vdd to each pixel 122, and the second signal line is configured to apply a second driving voltage Vss to each pixel 122. The first driving voltage Vdd may be generated in a high potential driving voltage source Vdd which is not shown in the drawing. The second driving voltage Vss may be generated in a low potential driving source Vss which is not shown in the drawing.

The timing controller 124 may receive a timing signal, such as a vertical synchronization signal Vsync, a horizontal synchronization signal Hsync, a dot clock signal DCLK, or a data enable signal DE, from an external graphic controller (not shown). In addition, the timing controller 124 may derive a data control signal DDC and a gate control signal GDC from the received timing signal. The data control signal DDC is used to control the timing of operation of the data driver 120. The gate control signal GDC is used to control the timing of operation of the gate driver 118.

The image processing circuit 60 may convert three-color digital video data RGB from an exterior (e.g. the external graphics controller) into four-color digital video data RGBW. In addition, the image processing circuit 60 may adjust the luminance of the four-color digital video data RGBW. The adjusted digital video data RGBW is applied from the image processing circuit 60 to the timing controller 124. Then, the timing controller 124 may rearrange the adjusted digital video data RGBW into a format suitable for the defined display panel 116. The rearranged digital video data RGBW is applied from the timing controller 124 to the data driver 120.

The gate driver 118 may generate a scan pulse in response to the gate control signal GDC from the timing controller 124. The scan pulse may be applied from the gate driver 118 to the gate lines G1 to Gn on the display panel 116 sequentially.

In addition, the gate driver 118 may output a sensing control signal SCS to the sensing control lines SC1 to SCn on the display panel 116 under the control of the timing controller 124. The sensing control signal SCS is used to control a sensing switch (not shown) included in each pixel.

Although it is explained that the gate driver 118 outputs both the scan pulse SP and the sensing control signal SCS, the present disclosure is not limited thereto. Optionally, the display apparatus may additionally include a sensing switch control driver which outputs the sensing control signal SCS under the control of the timing controller 124.

The data driver 120 may be controlled by the data control signal DDC applied from the timing controller 124. In addition, the data driver 120 may apply a sensing voltage to the sensing lines S1 to Sm. In addition, the data driver 120 may apply an analog data voltage to the data lines D1 to Dm on the display panel 116. To apply the analog data voltage to the data lines D1 to Dm, the data driver 120 may convert the four-color digital video data RGBW into the analog data voltage. The four-color digital video data RGBW is adjusted in luminance by the image processing circuit 60 and applied from the image processing circuit 60 via the timing controller 124.

The data lines D1 to Dm are connected to the pixels 122. Thus, the data voltage may be transmitted to the pixels 122 via the data lines D1 to Dm.

The sensing lines S1 to Sm are connected to the pixels 122. Thus, the sensing lines S1 to Sm may be used not only to apply the sensing voltage to the pixels 122 but also to measure the sensing voltage. This sensing voltage may be obtained by charging an initial voltage into the pixels through a corresponding sensing line S and into the pixels in a floating state. Although it is explained that the data driver 120 may output the data voltage and the sensing voltage and detect the sensing voltage, the present disclosure is not limited thereto. Optionally, the display apparatus may additionally include a sensing driver which outputs the sensing voltage and detects the sensing voltage.

Meanwhile, the image processing circuit 60 may be built in the timing controller 124. Optionally, in the display apparatus, the image processing circuit 60 is provided separately from the timing controller 124. In addition, it is described that the image processing circuit 60 is applied to the display apparatus, but the present disclosure is not limited thereto. In other words, the image processing circuit 60 may be applied to wireless communication devices such as wireless mobile handsets, digital cameras, video cameras, digital multi-players, personal digital assistants (PDAs), video game consoles, different types of video devices, and exclusive viewing stations (e.g. television receivers).

Figure 8:
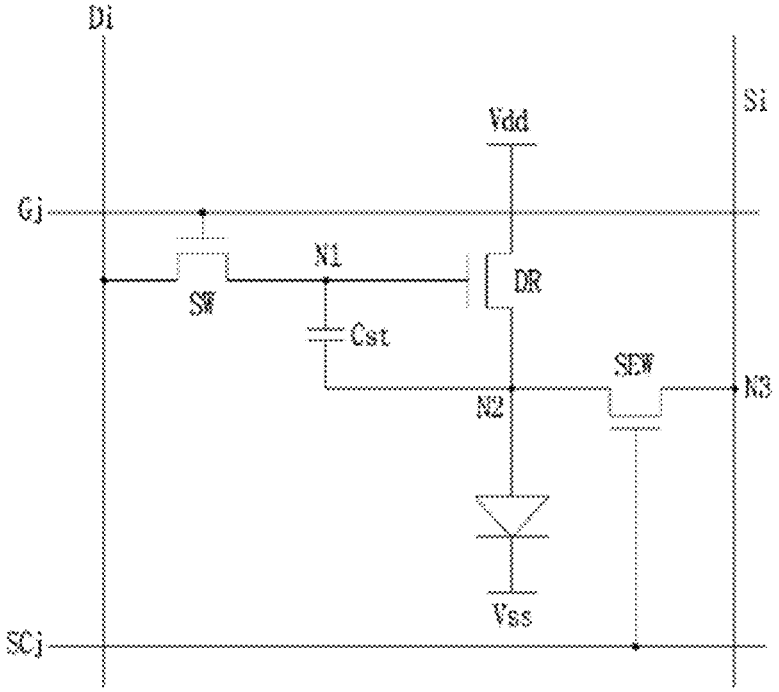
FIG. 8 is a circuit diagram of a configuration of a pixel according to an embodiment of the present disclosure.

FIG. 8 is a circuit diagram of a configuration of a pixel according to an embodiment of the present disclosure.

The pixel 122 in the present disclosure may be one of red, green, blue, and white pixels. In addition, the pixel 122 may be referred to as a sub-pixel.

The sub-pixel 122 may include a scan switch SW, a driving switch DR, a sensing switch SEW, an organic light emitting diode OLED and a storage capacitor Cst.

The scan switch SW may be a transistor for transmitting the data voltage on the data line Di. The scan switch SW may be controlled by the scan pulse SP on the gate line Gj and is connected between the data line Di and a first node N1.

The driving switch DR may be a transistor which adjusts a current flowing through the organic light emitting diode OLED through a voltage connected between the first node N1 and a second node N2 of a gate electrode and a source electrode of the transistor. Thus, the driving switch DR may include a gate electrode connected to the first node N1, a source electrode connected to the second node N2 and a drain electrode connected to a first driving voltage line Vdd.

The sensing switch SEW may be a transistor for initializing the second node N2 and detecting a threshold voltage of the driving switch DR via the sensing line S1. Such a sensing switch SEW may be controllable by the sensing control signal SCS on the sensing control line SCj and is connected between the second node N2 and a third node N3.

The organic light emitting diode OLED includes an anode electrode and a cathode electrode. The anode electrode may be connected to the second node N2 and the cathode electrode may be connected to a second driving voltage line Vss.

The storage capacitor Cst may be connected between the first node N1 and the second node N2. In other words, the storage capacitor Cst may be connected between the gate electrode and the source electrode of the driving switch DR.

The display apparatus may be a white OLED display apparatus.

Figure 9:
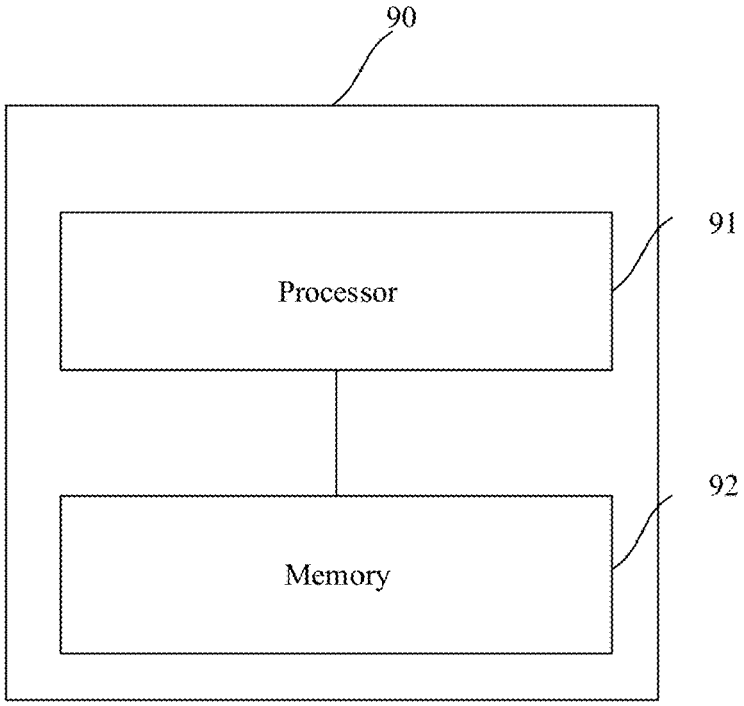
FIG. 9 is a schematic structural diagram of the display apparatus according to an embodiment of the present disclosure.

Referring to FIG. 9, the embodiments of the present disclosure further provide a display apparatus 90 including a processor 91, a memory 92, and a computer program stored on the memory 92 and executable on the processor 91. The computer program is executed by the processor 91 to implement various processes of the embodiments of the above image processing method and achieves the same technical effect, and in order to avoid repetition, the description thereof will not be repeated.

The embodiments of the present disclosure further provide a computer-readable storage medium having stored thereon a computer program, the computer program is executed by a processor to implement various processes of the embodiments of the above image processing method and achieves the same technical effect, and in order to avoid repetition, the description thereof will not be repeated. The computer-readable storage medium may be a read-only memory (ROM), a random access memory (RAM), a magnetic disk, an optical disk or the like.

The above method disclosed in the present disclosure may be applied to or implemented by a processor. The processor may be an integrated circuit chip having signal processing capabilities. In the implementation process, various steps of the above method may be performed by an integrated logic circuit in a form of hardware or instructions in a form of software in the processor. The above processor may be a general-purpose processor, a digital signal processor (DSP), an application specific integrated circuit (ASIC), a field programmable gate array (FPGA) or other programmable logic devices, a discrete gate or transistor logic device, or a discrete hardware component. Various methods, steps, and logical blocks disclosed in the present disclosure may be implemented or performed. The genera-purpose processor may be a microprocessor, any conventional processor or the like. The steps of the method disclosed in the present disclosure may be performed directly by a hardware decoding processor or by a combination of hardware and software modules in the hardware decoding processor. The software module may be located in a storage medium, such as a random access memory, a flash memory, a read-only memory, a programmable read-only memory, an electrically erasable programmable memory, or a register, which is well known in the art. The storage medium is located in a memory, the processor reads the information in the memory and performs the steps of the above method in combination with the hardware thereof.

It should be appreciated that the embodiments described herein may be implemented in a form of hardware, software, firmware, middleware, microcode, or a combination thereof. For a hardware implementation, processing elements may be implemented on one or more application specific integrated circuits (ASICs), digital signal processings (DSPs), DSP devices (DSPDs), programmable logic devices (PLDs), field-programmable gate arrays (FPGAs), general-purpose processors, controllers, microcontrollers, microprocessors, other electronic elements for performing the functions of the present disclosure, or a combination thereof.

For a software implementation, the technology of the present disclosure may be implemented by operating functional modules (e.g. processes, functions) of the present disclosure. Software codes may be stored in a memory and executed by a processor. The memory may be implemented in the processor or outside the processor.

The embodiments of the present disclosure are described above with reference to the accompanying drawings, but the present disclosure is not limited to the above specific embodiments which are merely illustrative and not restrictive. A person of ordinary skill in the art may further make numerous forms under the enlightenment of the present disclosure and without departing from the spirit of the present disclosure and the scope of protection of the claims, and all of these forms shall fall within the protection of the present disclosure.

What is claimed is:

1. An image processing method applied to a display apparatus, comprising:

converting an RGB gray-scale value of each pixel in a current image frame into an RGB luminance value;

converting the RGB luminance value into a first RGBW luminance value;

determining a luminance level of the current image frame according to the first RGBW luminance value corresponding to each pixel;

determining a luminance gain value of the current image frame according to the luminance level of the current image frame;

calculating a second RGBW luminance value according to the luminance gain value and the first RGBW luminance value; and converting the second RGBW luminance value into an RGBW gray-scale value, wherein the converting the RGB gray-scale value of each pixel in the current image frame into the RGB luminance value comprises:

converting the RGB gray-scale value of each pixel in the current image frame into the RGB luminance value through the following calculation formulas:

$LR=(R/GL)^Y, LG=(G/GL)^Y, LB=(B/GL)^Y$;

where, LR is an RGB luminance value of a red sub-pixel, R is an RGB gray-scale value of the red sub-pixel, LG is an RGB luminance value of a green sub-pixel, G is an RGB gray-scale value of the green sub-pixel, LB is an RGB luminance value of a blue sub-pixel, B is an RGB gray-scale value of the blue sub-pixel, GL is a maximum gray-scale value, and Y is a Gamma value.

2. The image processing method according to claim 1, wherein the converting the RGB gray-scale value of each pixel in the current image frame into the RGB luminance value comprises: converting the RGB gray-scale value of each pixel in the current image frame into the RGB luminance value by looking up an RGB gray scale-RGB luminance correspondence table.

3. The image processing method according to claim 1, wherein the converting the RGB luminance value into the first RGBW luminance value comprises:

converting the RGB luminance value into the first RGBW luminance value through the following calculation formulas:

$Lw=\min(LR, LG, LB)$, $Lr=LR-Lw$, $Lg=LG-Lw$, $Lb=LB-Lw$;

where, Lw is an RGBW luminance value of a white sub-pixel, Lr is an RGBW luminance value of a red sub-pixel, Lg is an RGBW luminance value of a green sub-pixel, Lb is an RGBW luminance value of a blue sub-pixel, LR is an RGB luminance value of the red sub-pixel, LG is an RGB luminance value of the green sub-pixel, and LB is an RGB luminance value of the blue sub-pixel.

4. The image processing method according to claim 1, wherein the luminance level of the current image frame is a sum of luminance values of various pixels in the current image frame, and the determining the luminance level of the current image frame according to the first RGBW luminance value corresponding to each pixel comprises:

determining the luminance level of the current image frame by using the following calculation formula:

$$\text{sum}=\sum_{i=1}^{l1}\sum_{j=1}^{l2}(Lr_{i,j}+Lg_{i,j}+Lb_{i,j}+Lw_{i,j})$$

where, sum is the sum of the luminance values of various pixels in the current image frame, l1 is the number of pixels in a row direction of the display apparatus, l2 is the number of pixels in a column direction of the display apparatus, $Lr_{i,j}$ is an RGBW luminance value of a red sub-pixel in an (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, and $Lw_{i,j}$ is an RGBW luminance value of a white sub-pixel in the (i, j)th pixel.

5. The image processing method according to claim 1, wherein the luminance level of the current image frame is an average luminance level of the current image frame, and the determining the luminance level of the current image frame according to the first RGBW luminance value corresponding to each pixel comprises:

determining the average luminance level of the current image frame by using the following calculation formulas:

$$\text{sum} = \sum_{i=1}^{l1} \sum_{j=1}^{l2} (Lr_{i,j} + Lg_{i,j} + Lb_{i,j} + Lw_{i,j})$$

$$APL = \text{sum}/(l1 * l2)$$

where, sum is a sum of luminance values of various pixels in the current image frame, APL is the average luminance level of the current image frame, l1 is the number of pixels in a row direction of the display apparatus, l2 is the number of pixels in a column direction of the display apparatus, $Lr_{i,j}$ is an RGBW luminance value of a red sub-pixel in an (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, and $Lw_{i,j}$ is an RGBW luminance value of a white sub-pixel in the (i, j)th pixel.

6. The image processing method according to claim 1, wherein the luminance level of the current image frame is a relative luminance level, and the determining the luminance level of the current image frame according to the first RGBW luminance value corresponding to each pixel comprises:

determining the relative luminance level of the current image frame by using the following calculation formulas:

$$\text{sum} = \sum_{i=1}^{l1} \sum_{j=1}^{l2} (Lr_{i,j} + Lg_{i,j} + Lb_{i,j} + Lw_{i,j})$$

$$K = \text{sum}/\text{sum}_{max}$$

where, sum is a sum of luminance values of various pixels in the current image frame, K is the relative luminance level of the current image frame, l1 is the number of pixels in a row direction of the display apparatus, l2 is the number of pixels in a column direction of the display apparatus, $Lr_{i,j}$ is an RGBW luminance value of a red sub-pixel in an (i, j)th pixel, $Lg_{i,j}$ is an RGBW luminance value of a green sub-pixel in the (i, j)th pixel, $Lb_{i,j}$ is an RGBW luminance value of a blue sub-pixel in the (i, j)th pixel, $Lw_{i,j}$ is an RGBW luminance value of a white sub-pixel in the (i, j)th pixel, and $\text{sum}_{max}$ is a maximum luminance value of the display apparatus.

7. The image processing method according to claim 4, wherein the determining the luminance gain value of the current image frame according to the luminance level of the current image frame comprises:

determining an average luminance level of the current image frame according to the sum of the luminance values of various pixels in the current image frame; and determining the luminance gain value of the current image frame by looking up an average luminance level-luminance gain value correspondence table.

8. The image processing method according to claim 5, wherein the determining the luminance gain value of the current image frame according to the luminance level of the current image frame comprises:

determining the luminance gain value of the current image frame by looking up an average luminance level-luminance gain value correspondence table.

9. The image processing method according to claim 6, wherein the determining the luminance gain value of the current image frame according to the luminance level of the current image frame comprises:

determining an average luminance level of the current image frame according to the relative luminance level K of the current image frame, the maximum luminance value $\text{sum}_{max}$ of the display apparatus and an average luminance level $APL_{maX}$ corresponding to the maximum luminance value of the display apparatus; and determining the luminance gain value of the current image frame by looking up an average luminance level-luminance gain value correspondence table.

10. The image processing method according to claim 1, wherein in a case that the average luminance level of the current image frame does not exceed a predetermined value, the luminance gain value of the current image frame is 1; and in a case that the average luminance level of the current image frame exceeds the predetermined value, the luminance gain value of the current image frame decreases as the average luminance level increases.

11. The image processing method according to claim 10, wherein the predetermined value is an average luminance level when a red color image, a green color image or a blue color image is displayed.

12. The image processing method according to claim 9, wherein $APL_{maX}$ is an average luminance level when any two of a red color image, a green color image and a blue color image are displayed.

13. The image processing method according to claim 1, wherein the calculating the second RGBW luminance value according to the luminance gain value and the first RGBW luminance value comprises:

calculating the second RGBW luminance value by using the following calculation formulas:

L'r=gain Lr, L'g=gain Lg, L'b=gain Lb, L'w=Lw+(1−gain) * (Lr+Lg+Lb)/3;

where, L'r is a second RGBW luminance value of a red sub-pixel, L'g is a second RGBW luminance value of a green sub-pixel, L'b is a second RGBW luminance value of a blue sub-pixel, L'w is a second RGBW luminance value of a white sub-pixel, gain is the luminance gain value, Lw is a first RGBW luminance value of the white sub-pixel, Lr is a first RGBW luminance value of the red sub-pixel, Lg is a first RGBW luminance value of the green sub-pixel, and Lb is a first RGBW luminance value of the blue sub-pixel.

14. An image processing circuit comprising:

a first conversion circuit, configured to convert an RGB gray-scale value of each pixel in a current image frame into an RGB luminance value;

a second conversion circuit, configured to convert the RGB luminance value into a first RGBW luminance value;

a first determination circuit, configured to determine a luminance level of the current image frame according to the first RGBW luminance value corresponding to each pixel;

a second determination circuit, configured to determine a luminance gain value of the current image frame according to the luminance level of the current image frame;

a calculation circuit, configured to calculate a second RGBW luminance value according to the luminance gain value and the first RGBW luminance value; and a third conversion circuit, configured to convert the second RGBW luminance value into an RGBW gray-scale value, wherein the first conversion circuit is further configured to:

convert the RGB gray-scale value of each pixel in the current image frame into the RGB luminance value through the following calculation formulas:

$LR=(R/GL)^Y, LG=(G/GL)^Y, LB=(B/GL)^Y$;

where, LR is an RGB luminance value of a red sub-pixel, R is an RGB gray-scale value of the red sub-pixel, LG is an RGB luminance value of a green sub-pixel, G is an RGB gray-scale value of the green sub-pixel, LB is an RGB luminance value of a blue sub-pixel, B is an RGB gray-scale value of the blue sub-pixel, GL is a maximum gray-scale value, and Y is a Gamma value.

15. A display apparatus comprising the image processing circuit according to claim 14.

16. A non-transitory computer-readable storage medium having stored thereon a computer program, wherein the computer program is executed by a processor to implement the steps of the image processing method according to claim 1.

17. An image processing method applied to a display apparatus, comprising:

converting an RGB gray-scale value of each pixel in a current image frame into an RGB luminance value;

converting the RGB luminance value into a first RGBW luminance value;

determining a luminance level of the current image frame according to the first RGBW luminance value corresponding to each pixel;

determining a luminance gain value of the current image frame according to the luminance level of the current image frame;

calculating a second RGBW luminance value according to the luminance gain value and the first RGBW luminance value; and converting the second RGBW luminance value into an RGBW gray-scale value, wherein the converting the RGB luminance value into the first RGBW luminance value comprises:

converting the RGB luminance value into the first RGBW luminance value through the following calculation formulas:

$Lw=\min(LR, LG, LB), Lr=LR-Lw, Lg=LG-Lw, Lb=LB-Lw$;

where, Lw is an RGBW luminance value of a white sub-pixel, Lr is an RGBW luminance value of a red sub-pixel, Lg is an RGBW luminance value of a green sub-pixel, Lb is an RGBW luminance value of a blue sub-pixel, LR is an RGB luminance value of the red sub-pixel, LG is an RGB luminance value of the green sub-pixel, and LB is an RGB luminance value of the blue sub-pixel.

* * * * *